US008527264B2

(12) United States Patent
Biswas et al.

(10) Patent No.: US 8,527,264 B2
(45) Date of Patent: Sep. 3, 2013

(54) METHOD AND SYSTEM FOR ENCODING AUDIO DATA WITH ADAPTIVE LOW FREQUENCY COMPENSATION

(75) Inventors: Arijit Biswas, Nuremberg (DE); Vinay Melkote, San Mateo, CA (US); Michael Schug, Erlangen (DE); Grant Allen Davidson, Burlingame, CA (US); Mark Stuart Vinton, San Francisco, CA (US)

(73) Assignees: Dolby Laboratories Licensing Corporation, San Francisco, CA (US); Dolby International AB, Amsterdam (NL)

( * ) Notice: Subject to any disclaimer, the term of this patent is extended or adjusted under 35 U.S.C. 154(b) by 0 days.

(21) Appl. No.: 13/588,890

(22) Filed: Aug. 17, 2012

(65) Prior Publication Data

US 2013/0179175 A1 Jul. 11, 2013

Related U.S. Application Data

(60) Provisional application No. 61/584,478, filed on Jan. 9, 2012.

(51) Int. Cl.
*G10L 19/00* (2013.01)

(52) U.S. Cl.
USPC ..... 704/200.1; 704/500; 704/501; 704/502; 704/208

(58) Field of Classification Search
USPC ..... 704/200.1, 500–504
See application file for complete search history.

(56) References Cited

U.S. PATENT DOCUMENTS 5,581,653 A * 12/1996 Todd ..... 704/229
5,583,962 A 12/1996 Davis et al. ..... 395/2.38
5,632,005 A 5/1997 Davis et al. ..... 395/2.95
5,633,981 A 5/1997 Davis ..... 395/2.39
5,727,119 A 3/1998 Davidson et al. ..... 395/2.12
6,021,386 A 2/2000 Davis et al. ..... 704/229
6,775,587 B1 * 8/2004 Absar et al. ..... 704/200.1
7,110,941 B2 * 9/2006 Li ..... 704/200.1

(Continued)

OTHER PUBLICATIONS

Uhle, "Applause Sound Detection," Journal of the AES, vol. 59, pp. 213-224 (Apr. 2011).

(Continued)

*Primary Examiner* — Talivaldis Ivars Smits
*Assistant Examiner* — Shaun Roberts
(74) *Attorney, Agent, or Firm* — Girard & Equitz LLP

(57) ABSTRACT

A method for determining mantissa bit allocation of frequency domain audio data to be encoded, including by performing adaptive low frequency compensation on each frequency band of a set of low frequency bands of the data. The low frequency compensation includes steps of: performing tonality detection on the audio data to generate compensation control data indicative of whether each frequency band in the set has prominent tonal content; and performing low frequency compensation on each frequency band in the set having prominent tonal content, including by correcting a preliminary masking value for each frequency band having prominent tonal content, but not performing low frequency compensation on the audio data in any other frequency band in the set; wherein the frequency domain audio data comprises an exponent value for said each low frequency band of the set, and the tonality detection includes determining, for said each low frequency band of the set, a measure of difference between exponents and corresponding tented exponents of the audio data. Other aspects are audio encoding methods including such tonality detection and low frequency compensation steps, and a system configured to perform any embodiment of the inventive method.

28 Claims, 3 Drawing Sheets

(56) References Cited

U.S. PATENT DOCUMENTS

| | | | | |
|---|---|---|---|---|
| 7,164,771 | B1 * | 1/2007 | Treurniet et al. | 381/56 |
| 7,333,930 | B2 * | 2/2008 | Baumgarte | 704/200.1 |
| 7,395,211 | B2 * | 7/2008 | Watson et al. | 704/500 |
| 7,460,991 | B2 * | 12/2008 | Jones et al. | 704/211 |
| 7,516,064 | B2 | 4/2009 | Vinton et al. | 704/206 |
| 2005/0010409 | A1 * | 1/2005 | Hull et al. | 704/243 |
| 2006/0004565 | A1 | 1/2006 | Eguchi | 704/200.1 |
| 2010/0292993 | A1 | 11/2010 | Vaillancourt et al. | 704/500 |
| 2011/0075855 | A1 | 3/2011 | Oh et al. | 381/73.1 |

OTHER PUBLICATIONS

Davison, et al., "Parametric Bit Allocation in a Perceptual Audio Coder," presented at the 97$^{th}$ AES Convention, San Francisco, California, 21 pages (Nov. 1994).

Flexible Perceptual Coding for Audio Transmission and Storage, by Craig C. Todd, et al *96$^{th}$ Convention of the Audio Engineering Society*, Feb. 26, 1994, Preprint 3796.

"Design and Implementation of AC-3 Coders," by Steve Vernon, *IEEE Trans. Consumer Electronics*, vol. 41, No. 3, Aug. 1995, pp. 754-759.

"Dolby Digital Audio Coding Standards," book chapter by Robert L. Andersen and Grant Davidson, in *The Digital Signal Processing Handbook*, Second Edition, Vijay K. Madisett Editor-in-Chief, CRC Press, 2009.

"High Quality, Low-Rate Audio Transform Coding for Transmission and Multimedia Applications," by Bosi et al, Audio Engineering Society Preprint 3365, 93rd AES Convent Oct. 1992.

Introduction to Dolby Digital Plus, an Enhancement to the Dolby Digital Coding System, AES Convention Paper 6196, 117$^{th}$ AES Convention, Oct. 28, 2004.

Digital Audio Compression Standard (AC-3, E-AC-3) Specification (ATSC A/52:2010), Nov. 22, 2010.

Chang-Neon Lee, et al., "On the Study of Noise Allocation for Speech Signal in Low Bit-rate Audio Coding," IEEE Signal Processing Letters, vol. 16, No. 10, pp. 849-852, Oct. 2009.

* cited by examiner

METHOD AND SYSTEM FOR ENCODING AUDIO DATA WITH ADAPTIVE LOW FREQUENCY COMPENSATION

CROSS-REFERENCE TO RELATED APPLICATION

This application claims the benefit of U.S. Provisional Application No. 61/584,478, filed Jan. 9, 2012, entitled "Method and System for Encoding Audio Data with Adaptive Low Frequency Compensation."

BACKGROUND OF THE INVENTION

1. Field of the Invention

The invention pertains to audio signal processing, and more particularly, to encoding of audio data with adaptive low frequency compensation. Some embodiments of the invention are useful for encoding audio data in accordance with one of the formats known as Dolby Digital (AC-3) and Dolby Digital Plus (E-AC-3), or in accordance with another encoding format. Dolby, Dolby Digital, and Dolby Digital Plus are trademarks of Dolby Laboratories Licensing Corporation.

2. Background of the Invention

Although the invention is not limited to use in encoding audio data in accordance with the AC-3 (Dolby Digital) format (or the Dolby Digital Plus format), for convenience it will be described in embodiments in which it encodes an audio bitstream in accordance with the AC-3 format. An AC-3 encoded bitstream comprises one to six channels of audio content, and metadata indicative of at least one characteristic of the audio content. The audio content is audio data that has been compressed using perceptual audio coding.

Details of AC-3 (also known as Dolby Digital) coding are well known and are set forth in many published references including the following:

*ATSC Standard A52/A: Digital Audio Compression Standard (AC-3), Revision A*, Advanced Television Systems Committee, 20 Aug. 2001;

Flexible Perceptual Coding for Audio Transmission and Storage," by Craig C. Todd, et al, 96$^{th}$ *Convention of the Audio Engineering Society,* Feb. 26, 1994, Preprint 3796;

"Design and Implementation of AC-3 Coders," by Steve Vernon, *IEEE Trans. Consumer Electronics*, Vol. 41, No. 3, August 1995;

"Dolby Digital Audio Coding Standards," book chapter by Robert L. Andersen and Grant A. Davidson in *The Digital Signal Processing Handbook*, Second Edition, Vijay K. Madisetti, Editor-in-Chief, CRC Press, 2009;

"High Quality, Low-Rate Audio Transform Coding for Transmission and Multimedia Applications," by Bosi et al, Audio Engineering Society Preprint 3365, 93rd AES Convention, October, 1992; and U.S. Pat. Nos. 5,583,962; 5,632,005; 5,633,981; 5,727,119; and 6,021,386.

Details of Dolby Digital (AC-3) and Dolby Digital Plus (sometimes referred to as Enhanced AC-3 or "E-AC-3") coding are set forth in "Introduction to Dolby Digital Plus, an Enhancement to the Dolby Digital Coding System," AES Convention Paper 6196, 117$^{th}$ AES Convention, Oct. 28, 2004, and in the Dolby Digital/Dolby Digital Plus Specification (ATSC A/52:2010), available at http://www.atsc.org/cms/index.php/standards/published-standards.

In AC-3 encoding of an audio bitstream, blocks of input audio samples to be encoded undergo time-to-frequency domain transformation resulting in blocks of frequency domain data, commonly referred to as transform coefficients, frequency coefficients, or frequency components, located in uniformly spaced frequency bins. The frequency coefficient in each bin is then converted (e.g., in BFPE stage 7 of the FIG. 1 system) into a floating point format comprising an exponent and a mantissa.

Typical embodiments of AC-3 (and Dolby Digital Plus) encoders (and other audio data encoders) implement a psychoacoustic model to analyze the frequency domain data on a banded basis (i.e., typically 50 nonuniform bands approximating the frequency bands of the well known psychoacoustic scale known as the Bark scale) to determine an optimal allocation of bits to each mantissa. The mantissa data is then quantized (e.g., in quantizer 6 of the FIG. 1 system) to a number of bits corresponding to the determined bit allocation. The quantized mantissa data is then formatted (e.g., in formatter 8 of the FIG. 1 system) into an encoded output bitstream.

Typically, the mantissa bit assignment is based on the difference between a fine-grain signal spectrum (represented by a power spectral density ("PSD") value for each frequency bin) and a coarse-grain masking curve (represented by a mask value for each frequency band). Typically also, the psychoacoustic model implements low frequency compensation (sometimes referred to as "lowcomp" compensation or "lowcomp") to determine correction values (sometimes referred to herein as "lowcomp" parameter values) for correcting the masking curve values for low frequency bands. Each lowcomp parameter value may be subtracted from (or otherwise applied to) a preliminary masking curve value for a different one of the low frequency bands, in order to generate a final masking curve value for the band.

As noted, mantissa bit assignment in audio encoding can be based on the difference between signal spectrum and a masking curve. A simple algorithm for implementing such bit assignment may assume that quantization noise in one particular frequency band is independent of bit assignments in neighboring bands. However, this is typically not a reasonable assumption, especially at lower frequencies, due to finite frequency selectivity and high degree of overlap between bands in the decoder filter-bank, and due to leakage from one band into neighboring bands at low frequencies, where the slope of the masking curve can equal or exceed the slope of the filter-bank transition skirts.

Thus, the mantissa bit assignment process in audio encoding often includes a low frequency compensation process which determines a corrected masking curve. The corrected masking curve is then used to determine a signal-to-mask ratio value for each frequency component of the audio data. Low frequency compensation is a decoder selectivity compensation process for improved coding performance at low frequencies for signals with prominent low-frequency tonal components. Typically, low frequency compensation is a filter-bank response correction that, for convenience, may be incorporated into the computation of the excitation function which is used to determine the signal-to-mask values. As will be explained in greater detail below, a typical implementation of low frequency compensation searches for prominent low frequency signal components by looking for frequency bands with a PSD value that is 12-dB less than the PSD value for the next (higher frequency) band. When such a PSD value is found, the excitation function value for the band is immediately reduced by 18 dB (or an amount up to 18 dB). This reduction is then slowly backed out by 3 dB per subsequent band.

FIG. 1 is an encoder configured to perform AC-3 (or enhanced AC-3) encoding on time-domain input audio data 1. Analysis filter bank 2 converts the time-domain input audio data 1 into frequency domain audio data 3, and block floating point encoding (BFPE) stage 7 generates a floating point representation of each frequency component of data 3, comprising an exponent and mantissa for each frequency bin. The frequency-domain data output from stage 7 will sometimes also be referred to herein as frequency domain audio data 3. The frequency domain audio data output from stage 7 are then encoded, including by quantization of its mantissas in quantizer 6 and tenting of its exponents (in tenting stage 10) and encoding (in exponent coding stage 11) of the tented exponents generated in stage 10. Formatter 8 generates an AC-3 (or enhanced AC-3) encoded bitstream 9 in response to the quantized data output from quantizer 6 and coded differential exponent data output from stage 11.

Quantizer 6 performs bit allocation and quantization based upon control data (including masking data) generated by controller 4. The masking data (determining a masking curve) is generated from the frequency domain data 3, on the basis of a psychoacoustic model (implemented by controller 4) of human hearing and aural perception. The psychoacoustic modeling takes into account the frequency-dependent thresholds of human hearing, and a psychoacoustic phenomenon referred to as masking, whereby a strong frequency component close to one or more weaker frequency components tends to mask the weaker components, rendering them inaudible to a human listener. This makes it possible to omit the weaker frequency components when encoding audio data, and thereby achieve a higher degree of compression, without adversely affecting the perceived quality of the encoded audio data (bitstream 9). The masking data comprises a masking curve value for each frequency band of the frequency domain audio data 3. These masking curve values represent the level of signal masked by the human ear in each frequency band. Quantizer 6 uses this information to decide how best to use the available number of data bits to represent the frequency domain data of each frequency band of the input audio signal.

Controller 4 may implement a conventional low frequency compensation process (sometimes referred to herein as "lowcomp" compensation) to generate lowcomp parameter values) for correcting the masking curve values for the low frequency bands. The corrected masking curve values are used to generate the signal-to-mask ratio value for each frequency component of the frequency-domain audio data 3. Low frequency compensation is a feature of the psychoacoustic model typically implemented during AC-3 (and Dolby Digital Plus) encoding of audio data. Lowcomp compensation improves the encoding of highly tonal low-frequency components (of the input audio data to be encoded) by preferentially reducing the mask in the relevant frequency region, and in consequence allocating more bits to the code words employed to encode such components.

Lowcomp compensation determines a lowcomp parameter for each low frequency band. The lowcomp parameter for each band is effectively subtracted from an "excitation" value (which is determined in a well-known manner) for the band, and the resulting difference values are used to determine the corrected masking curve values. Reducing the excitation value for a band (e.g., by subtracting a lowcomp parameter therefrom, or increasing the value of a lowcomp parameter that is subtracted therefrom) results in increasing the number of bits allocated to the encoded version of the audio in the band for the following reason. While the excitation value for a band is not necessarily equal to the final (corrected) mask value (which is effectively subtracted from the audio data value for the band), it is used in the calculation of the final mask value (the final mask value takes into account absolute hearing thresholds and potentially other wideband and/or banded adjustments). Since the number of coding bits allocated to audio in a band is greater if the "signal to mask" ratio for the band is greater, reducing the mask value for a band would increase the number of bits allocated to the encoded version of the audio in that band. Therefore, reducing the excitation value for a band generally leads to a reduced mask value for the band, and consequently, an increase in the number of allocated bits for that band.

We next describe in more detail the manner in which conventional lowcomp compensation would typically be performed by the psychoacoustic model (e.g., the model implemented by controller 4 of FIG. 1). Controller 4 would scan through the low frequency bands (in the range from 0 Hz to 2.05 kHz, at 48 kHz sampling frequency) to look for a steep (12 dB) increase in power spectral density (PSD) between the current frequency band and the following (higher frequency) band, which is one characteristic of a strong tonal component. In response to identifying a PSD in a low frequency band as being indicative of a strong tonal component, lowcomp compensation is applied to cause more bits to be allocated to the data employed to encode the identified strong low frequency tonal component.

It will be understood that in AC-3 and Dolby Digital Plus encoding, each component of the frequency-domain audio data 3 (i.e., the contents of each transform bin) has a floating point representation comprising a mantissa and an exponent. To simplify the calculation of the masking curve, the Dolby Digital family of coders uses only the exponents to derive the masking curve. Or, stated alternately, the masking curve depends on the transform coefficient exponent values but is independent of the transform coefficient mantissa values. Because the range of exponents is rather limited (generally, integer values from 0-24), the exponent values are mapped onto a PSD scale with a larger range (generally, integer values from 0-3072) for the purposes of computing the masking curve. Thus, the loudest frequency components (i.e., those with an exponent of 0) are mapped to a PSD value of 3072, while the softest frequency-domain data components (i.e., those with an exponent of 24) are mapped to a PSD value of 0.

It is known that in conventional Dolby Digital (or Dolby Digital Plus) encoding, differential exponents (i.e., the difference between consecutive exponents) are coded instead of absolute exponents. The differential exponents can only take on one of five values: 2, 1, 0, −1, and −2. If a differential exponent outside this range is found, one of the exponents being subtracted is modified so that the differential exponent (after the modification) is within the noted range (this conventional method is known as "exponent tenting" or "tenting"). Tenting stage 10 of the FIG. 1 encoder generates tented exponents in response to the raw exponents asserted thereto, by performing such a tenting operation.

Consider an example of a typical implementation of lowcomp compensation in which the psychoacoustic model (e.g., the model implemented by controller 4 of FIG. 1) scans through the low frequency bands, with band "N+1" being the next band, and the current band, "N," having lower frequency than the next band. The scan may be from the lowest frequency band until band number 22, and typically does not include the last band of a LFE (low-frequency effects) channel. If it is determined that the PSD value for band N+1 minus the PSD value for band N is equal to 256 (which is indicative of a steep increase (12 dB) in PSD from the current band, N, to the next (higher frequency) band, N+1, lowcomp compensation is performed by immediately reducing the excitation function calculation for the current band (i.e., reducing the excitation value for the band) by 18 dB. The excitation value for the band is reduced by subtracting a lowcomp parameter equal to 384 from the excitation value that would otherwise be determined for the band. This excitation value reduction is slowly backed out (e.g., by up to 3 dB per subsequent band).

For subsequent bands, i.e., bands higher in frequency than a band for which lowcomp is initially enabled, if it is determined that the difference in PSD between one band and the next band is less than 256, the lowcomp parameter (that is subtracted from the excitation value for the band) is either maintained at the same value as for the previous band or reduced to a lower value. Until it is first determined (during a scan through all the low frequency bands) that the difference in PSD between two adjacent bands is equal to 256, lowcomp compensation is not performed (i.e., a lowcomp parameter having the value zero is "subtracted" from excitation values for the bands).

While the conventional Lowcomp process is beneficial for tonal signals with prominent low-frequency components, a handicap is that the 12 dB PSD difference criterion that triggers mask reduction is frequently met by a large number of non-tonal signals having low-frequency content. Audio data indicative of applause by a crowd is a well-known example of such a non-tonal signal, and will be referred to herein as representative of a non-tonal signal of the type (which is distinguished from a tonal signal in typical embodiments of the present invention). The inventors have recognized that redistributing coding bits from low to mid/high frequencies (relative to the coding bit distribution that would be employed in conventional AC-3 or E-AC-3 encoding with conventional lowcomp compensation) improves the perceived quality of applause and other non-tonal signals reproduced following the decoding of AC-3 (or E-AC-3) encoded versions of the signals, and thus that it would be desirable to disable lowcomp compensation of such non-tonal signals during AC-3 or E-AC-3 encoding of them (i.e., it would be desirable to switch lowcomp OFF during encoding of such signals). The inventors have also recognized that disabling of lowcomp compensation during AC-3 (or E-AC-3) encoding of tonal signals having low frequency content (e.g., signals produced by pitch pipes) during such encoding degrades the perceived quality of the tonal signals when they are reproduced following the decoding of AC-3 (or E-AC-3) encoded versions thereof.

Thus, the inventors have recognized that it would be desirable to implement an encoder that can adaptively apply low frequency compensation during encoding of audio signals having prominent low-frequency tonal components, but not during encoding of audio signals that do not have prominent low-frequency tonal components (e.g., applause signals, or other audio signals having low-frequency non-tonal content but not prominent tonal low-frequency content), and to do so in a manner that requires no decoder changes (i.e., in a manner allowing a conventional decoder to decode encoded audio that has been generated by the inventive encoder).

Some conventional audio encoding methods, in which mantissa bit assignment is based on the difference between signal spectrum and a masking curve, perform at least one masking value correction process, in addition to low frequency compensation, during generation of masking values for banded, frequency domain audio data to be encoded.

For example, some conventional audio encoders (e.g., AC-3 and E-AC-3 encoders) implement delta bit allocation, which is a provision for parametrically adjusting the masking curve for each audio channel to be encoded, in accordance with an additional improved psychoacoustic analysis. The encoder transmits additional bit stream codes designated as deltas, which convey differences between the masking curve employed and a default masking curve (i.e., the difference between the masking value determined by the default masking model at each frequency and the masking value determined by the improved masking model actually employed at the same frequency).

The delta bit allocation function is typically constrained to be a stair step function (e.g., ±6 dB steps up to ±18 dB). Each tread of the stair step corresponds to a masking level adjustment for an integral number of adjoining one-half Bark bands. Stair steps comprise a number of non-overlapping variable-length segments. The segments are run-length coded for transmission efficiency.

A conventional application of delta bit allocation is the conventional BABNDNORM process for masking level correction. In the BABNDNORM process (an example of a masking value correction process), for perceptual bands number 29 and above (of the Bark frequency bands employed in AC-3 and Enhanced AC-3 encoding), the signal energy in each perceptual band used to derive the excitation function is scaled by a value proportional to the inverse of the perceptual band width. Because all perceptual bands below band 29 have unit bandwidth (i.e., include only a single frequency bin), there is no need to scale signal energies for bands below 29. At progressively higher frequencies, the excitation function and hence the masking threshold estimate is lowered. This increases bit allocation at higher frequencies, particularly in the coupling channel. Some audio encoders which implement AC-3 (or E-AC-3) encoding are configured to implement the BABNDNORM process as a step of the encoding.

FIG. 5 is a graph of banded PSD (perceptual energy) values (the top curve) of banded, frequency domain audio data, a graph of scaled banded PSD values (the second curve from the top) generated by applying a conventional BABNDNORM process to the audio data, a graph of an excitation function (the third curve from the top) generated (e.g., by a conventional AC-3 or E-AC-3 encoder) for use in masking the audio data, and a graph of a scaled version of the excitation function (the bottom curve) generated (e.g., by a conventional AC-3 or E-AC-3 encoder) by applying a conventional BABNDNORM process to the excitation function. Each of the four curves is represented on a perceptual band (Bark frequency) scale. It is apparent that the top two curves begin to diverge from each other at band 29, and that the bottom two curves also begin to diverge from each other at band 29.

FIG. 6 is a graph of a frequency spectrum of an audio signal (the curve of FIG. 6 having widest dynamic range), a graph of a default masking curve for masking the audio signal (the second curve from the bottom), and a graph of a scaled version of the masking curve (the bottom curve) generated (e.g., by a conventional AC-3 or E-AC-3 encoder) by applying a conventional BABNDNORM process to the masking curve. It is apparent from FIG. 6 that at progressively higher frequencies, the BABNDNORM process lowers the masking curve by greater amounts.

BRIEF DESCRIPTION OF THE INVENTION

In a first class of embodiments, the invention is a mantissa bit allocation method for determining mantissa bit allocation of audio data values of frequency domain audio data to be encoded (including by undergoing quantization). The allocation method includes a step of determining masking values for the audio data values, including by performing adaptive low frequency compensation on the audio data of each frequency band of a set of low frequency bands of the audio data, such that the masking values are useful to determine signal-to-mask values which determine the mantissa bit allocation for said audio data. The adaptive low frequency compensation includes the steps of:

(a) performing tonality detection on the audio data to generate compensation control data indicative of whether each frequency band in the set of low frequency bands has prominent tonal content; and (b) performing low frequency compensation on the audio data in each frequency band in the set of low frequency bands having prominent tonal content as indicated by the compensation control data, including by correcting a preliminary masking value for said each frequency band having prominent tonal content, but not performing low frequency compensation on the audio data in any other frequency band in the set of low frequency bands, so that the masking value for each said other frequency band is an uncorrected preliminary masking value.

In some embodiments in the first class, step (a) includes a step of performing tonality detection on the audio data to generate compensation control data indicative of whether each frequency band of at least a subset of the frequency bands of the audio data (not necessarily low frequency bands) has prominent tonal content, and the step of determining masking values for the audio data values also includes a step of:

(c) performing a masking value correction process in a first manner for said each frequency band of the audio data having prominent tonal content as indicated by the compensation control data, including by correcting a preliminary masking value for said each frequency band having prominent tonal content, and performing the masking value correction process in a second manner for said each frequency band of the audio data which lacks prominent tonal content as indicated by the compensation control data.

For example, the masking value correction process may be a BABNDNORM process, said each frequency band may be a perceptual band, and step (c) may include the step of performing the BABNDNORM process with a first scaling constant for said each frequency band having prominent tonal content, and performing the BABNDNORM process with a second scaling constant for said each frequency band which lacks prominent tonal content.

Another embodiment of the invention is an encoding method including any embodiment of such a mantissa allocation method.

In a second class of embodiments, the invention is an audio encoding method which overcomes the limitations of conventional encoding methods that apply low frequency compensation to all input audio signals (including both signals with tonal and non-tonal low frequency content), or do not apply low frequency compensation to any input audio signal. These embodiments selectively (adaptively) apply low frequency compensation during encoding of audio signals having prominent low-frequency tonal components, but not during encoding of audio signals that do not have prominent low-frequency tonal components (e.g., applause or other audio signals having low-frequency non-tonal content but not prominent tonal low-frequency content). The adaptive low frequency compensation is performed in a manner that allows a decoder to perform decoding of the encoded audio without determining (or being informed as to) whether or not low frequency compensation was applied during the encoding.

A typical embodiment in the second class is an audio encoding method including the steps of:

(a) performing tonality detection on frequency domain audio data to generate compensation control data indicative of whether each low frequency band of a set of at least some low frequency bands of the audio data has prominent tonal content; and (b) performing low frequency compensation to generate a corrected masking value for the audio data in each said low frequency band having prominent tonal content as indicated by the compensation control data, and generating a masking value for the audio data in each other low frequency band in the set without performing low frequency compensation.

In some embodiments, the audio encoding method is an AC-3 or Enhanced AC-3 encoding method. In these embodiments, the low frequency compensation is preferably performed (i.e., is ON or enabled) for frequency bands of input audio data for which lowcomp was initially designed (i.e., frequency bands indicative of prominent, long-term stationary ("tonal"), low frequency content), and is not performed (i.e., is OFF or effectively disabled) otherwise. In these embodiments, in response to compensation control data indicating that low frequency compensation should not be performed on a frequency band of the audio data (e.g., compensation control data indicating that the band includes non-tonal audio content but not prominent tonal content), step (b) preferably includes a step of "re-tenting" the audio data in said band to generate modified audio data for the band, said modified audio data for the band including a modified exponent. The re-tenting generates the modified audio data for the band such that the differential exponent for the band is prevented from being equal to −2 (e.g., so that the exponent of the audio data in the next higher frequency band minus the modified exponent of the modified audio data for the band must be equal to 2, 1, 0, or −1). Thus, lowcomp compensation would not be applied to the band because the criterion for applying lowcomp compensation to the band (a PSD increase of 12 dB for the band, relative to the PSD for the next lower frequency band) would not be met (this criterion could not be met if the exponent of the modified ("re-tented") audio data for the band, minus the exponent for next lower frequency band, is prevented from being equal to −2).

More specifically, in some such embodiments, for each band (the "Nth" band) for which re-tenting prevents the differential exponent from being equal to −2, lowcomp compensation is "not applied" (or switched OFF or effectively disabled) in the following sense. The modified differential exponent for the band (resulting from the re-tenting) is −1, 0, 1, or 2. Thus, if the differential exponent for the previous (lower frequency) band (the "(N−1)th" band) was −2 (which could occur if the tonality detection step indicated strong tonal content for the "(N−1)" th band to prevent re-tenting for the "(N−1)" th band, and lack of tonal content for the "N" th band to trigger re-tenting for the "N" th band), and lowcomp had applied (in the conventional manner) a full mask adjustment to the "(N−1)" th band (i.e., the inventive tonal detection had not prevented lowcomp from doing so), conventional lowcomp (without re-tenting) would apply a sequence of progressively smaller mask adjustments (for a small number of bands following the "(N−1)th" band, including the Nth band) until it reaches a band for which it makes a zero adjustment (assuming that none of the differential exponents for these bands equals −2). In the embodiments described in the present paragraph, when re-tenting (in accordance with the invention) prevents the differential exponent for a band (the "Nth" band) from being equal to −2 (i.e., because the inventive tonal detection step indicates non-tonal content for the band), if lowcomp had applied a mask adjustment to the previous band (the "(N−1)th" band), lowcomp is allowed to continue its sequence of progressively smaller mask adjustments for the Nth band (and possibly also for a small number of subsequent bands) until it reaches the first band for which it makes a zero adjustment. At this point, lowcomp is prevented from making any further mask adjustment until the inventive tonal detection indicates a tonal signal.

In other embodiments, when the inventive tonality detection step indicates non-tonal content for any low frequency band (or for all low frequency bands, considered together) in the set to which lowcomp would conventionally be applied, lowcomp compensation is "not applied" (or switched OFF or effectively disabled) in the following sense. In response to the inventive tonality detection step indicating non-tonal content for at least one low frequency band in the set, subtraction of nonzero lowcomp parameters from the excitation function for all the bands in the set terminates (e.g., immediately). At this point, lowcomp is prevented from making any mask adjustment (until commencement of a new sweep through the bands of a next set of frequency domain audio data).

In some embodiments, the compensation control data indicates whether each individual low frequency band in the set has prominent tonal content, and low frequency compensation is selectively applied (or not applied) to each individual low frequency band in the set. In other embodiments, the compensation control data indicates whether the low frequency bands in the set (considered together) have prominent tonal content, and low frequency compensation is either applied to all the low frequency bands in the set or is not applied to any of the low frequency bands in the set (depending on the content of the compensation control data).

In some embodiments in the second class, step (a) includes a step of performing tonality detection on the audio data to generate compensation control data indicative of whether each frequency band of at least a subset of the frequency bands (not necessarily low frequency bands) of the audio data has prominent tonal content, and the step of determining masking values for the audio data values also includes a step of:

(c) performing a masking value correction process in a first manner for said each frequency band of the audio data having prominent tonal content as indicated by the compensation control data, and performing the masking value correction process in a second manner for said each frequency band of the audio data which lacks prominent tonal content as indicated by the compensation control data.

For example, the masking value correction process may be a BABNDNORM process, said each frequency band may be a perceptual band, and step (c) may include the step of performing the BABNDNORM process with a first scaling constant for said each frequency band having prominent tonal content, and performing the BABNDNORM process with a second scaling constant for said each frequency band which lacks prominent tonal content.

In another class of embodiments, the invention is an audio encoder configured to generate encoded audio data in response to frequency domain audio data, including by performing adaptive low frequency compensation on the audio data, said encoder including:

a tonality detector (e.g., element 15 of FIG. 2) configured to perform tonality detection on the audio data to generate compensation control data indicative of whether each low frequency band of a set of at least some low frequency bands of the audio data has prominent tonal content; and a low frequency compensation control stage (e.g., implemented by element 4 of FIG. 2) coupled and configured to adaptively enable (selectively enable or effectively disable), in response to the compensation control data, application of low frequency compensation to each low frequency band of the set of low frequency bands of the audio data.

The tonality detector is configured to determine whether low frequency compensation should be applied to audio data of each frequency band of the set of low frequency bands (i.e., by generating compensation control data indicating whether low frequency compensation of each frequency band of the set of low frequency bands should be switched ON because the band has prominent tonal content, or switched OFF because the band lacks prominent tonal content, during encoding of the audio data of the set of low frequency bands). The low frequency compensation control stage is configured to adaptively enable application of low frequency compensation to the audio data of each band of the set of low frequency bands in response to the compensation control data, in a manner that requires no decoder changes (i.e., in a manner that allows a decoder to perform decoding of the encoded audio data without determining (or being informed as to) whether or not low frequency compensation was applied to any low frequency band during encoding.

In response to compensation control data indicating that a frequency band of the audio data to be encoded is indicative of a non-tonal signal (for which low frequency compensation should be disabled), a preferred embodiment of the low frequency compensation control stage "re-tents" the audio data of the band by artificially modifying the exponent thereof. The re-tenting generates modified audio data for the band such that the differential exponent for the band is prevented from being equal to −2 (e.g., so that the modified exponent of the modified audio data for the band, minus the exponent of the audio data in the next lower frequency band must be equal to 2, 1, 0, or −1). In typical embodiments of the encoder, lowcomp compensation would not be applied to the band because the criterion for applying lowcomp compensation to the band (a PSD increase of 12 dB for the band, relative to the PSD for the next lower frequency band) would not be met (this criterion could not be met if the exponent of the modified audio data for the band, minus the exponent for next lower frequency band, is prevented from being equal to −2).

Another aspect of the invention is a method for decoding encoded audio data, including the steps of receiving a signal indicative of encoded audio data, where the encoded audio data have been generated by encoding audio data in accordance with any embodiment of the inventive encoding method, and decoding the encoded audio data to generate a signal indicative of the audio data. Another aspect of the invention is a system including an encoder configured (e.g., programmed) to perform any embodiment of the inventive encoding method to generate encoded audio data in response to audio data, and a decoder configured to decode the encoded audio data to recover the audio data.

Other aspects of the invention include a system or device (e.g., an encoder or a processor) configured (e.g., programmed) to perform any embodiment of the inventive method, and a computer readable medium (e.g., a disc) which stores code for implementing any embodiment of the inventive method or steps thereof. For example, the inventive system can be or include a programmable general purpose processor, digital signal processor, or microprocessor, programmed with software or firmware and/or otherwise configured to perform any of a variety of operations on data, including an embodiment of the inventive method or steps thereof. Such a general purpose processor may be or include a computer system including an input device, a memory, and processing circuitry programmed (and/or otherwise configured) to perform an embodiment of the inventive method (or steps thereof) in response to data asserted thereto.

DETAILED DESCRIPTION OF EMBODIMENTS OF THE INVENTION

Figure 1:
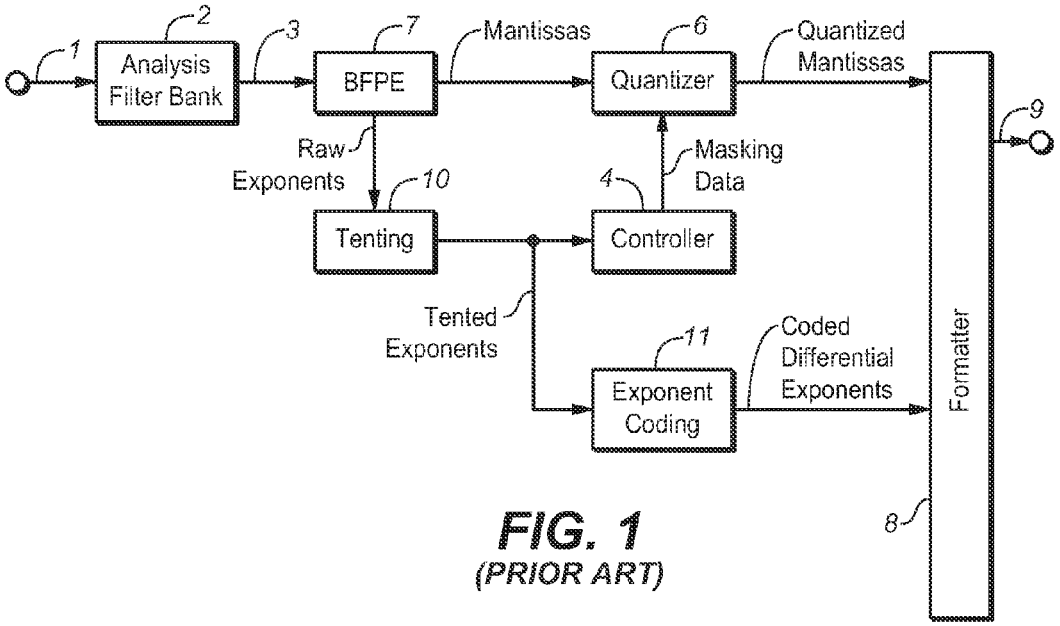
FIG. 1 (PRIOR ART)
FIG. 1 is a block diagram of a conventional encoding system.
Figure 2:
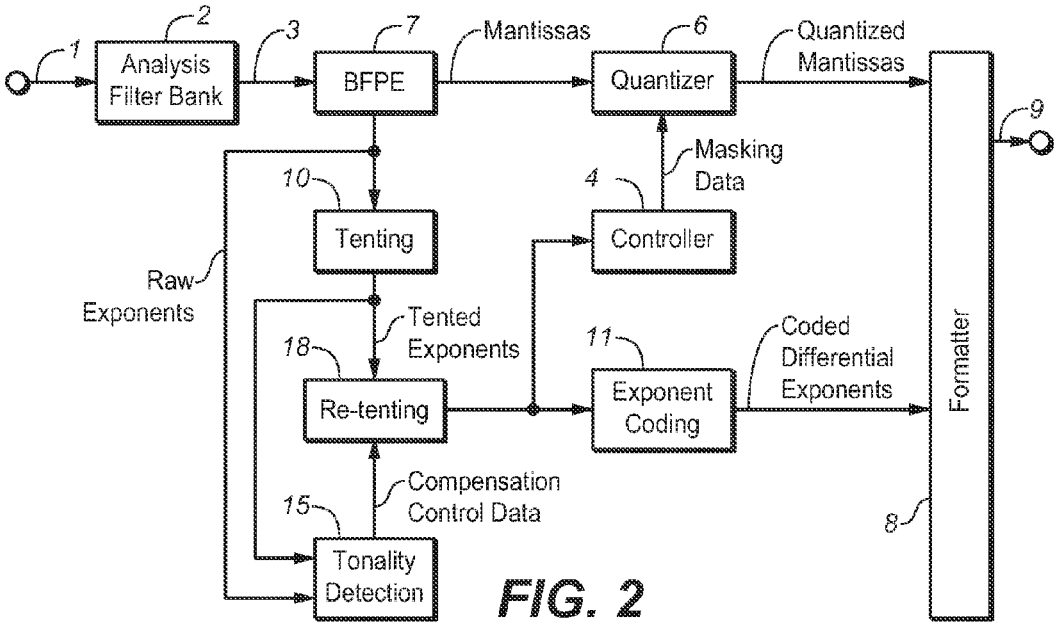
FIG. 2 is a block diagram of an encoding system configured to perform an embodiment of the inventive method.

An embodiment of a system configured to implement the inventive method will be described with reference to FIG. 2. The system of FIG. 2 is an AC-3 (or enhanced AC-3) encoder, which is configured to generate an AC-3 (or enhanced AC-3) encoded audio bitstream 9 in response to time-domain input audio data 1. Elements 2, 4, 6, 7, 8, 10, and 11 of the FIG. 2 system are identical to the identically numbered elements of the above-described FIG. 1 system.

Analysis filter bank 2 converts the time-domain input audio data 1 into frequency domain audio data 3, and BFPE stage 7 generates a floating point representation of each frequency component of data 3, comprising an exponent and mantissa for each frequency bin. The frequency domain audio data output from stage 7 (sometimes also referred to herein as frequency domain audio data 3) are then encoded, including by quantization of its mantissas in quantizer 6. Formatter 8 is configured to generate an AC-3 (or enhanced AC-3) encoded bitstream 9 in response to the quantized mantissa data output from quantizer 6 and coded differential exponent data output from stage 11. Quantizer 6 performs bit allocation and quantization based upon control data (including masking data) generated by controller 4.

Controller 4 is configured to perform low frequency compensation on each low frequency band of a set of low frequency bands of audio data 3, by correcting a preliminary masking value (an excitation value) for said band. The corrected masking data asserted by controller 4 to quantizer 6 for the band is determined by the corrected masking value for said band.

Because the system of FIG. 2 is an AC-3 (or enhanced AC-3) encoder, controller 4 implements a psychoacoustic model to analyze the frequency domain data on the basis of 50 nonuniform perceptual bands, which approximate the frequency bands of the well known Bark scale. Other embodiments of the invention employ a psychoacoustic model to analyze frequency domain data (and/or implement low frequency compensation and optionally also another masking value correction process) on another banded basis (i.e., on the basis of any set of uniform or non-uniform frequency bands).

The encoder of FIG. 2 includes the inventive re-tenting stage 18 and tonality detector 15. Tenting stage 10 of FIG. 2 is coupled and configured to assert the tented exponents which it generates to tonality detector 15 and to re-tenting stage 18. Re-tenting stage 18 is configured to generate re-tented exponents which cause controller 4 (operating in response to the re-tented exponents) to perform low frequency compensation on a frequency band only in response to compensation control data (generated by detector 15 and asserted to stage 18) indicating that low frequency compensation should be performed on the band. In response to compensation control data (generated by detector 15 and asserted to stage 18) which indicates that low frequency compensation should not be performed on a frequency band of audio data 3, controller 4 does not perform low frequency compensation on the band and instead, the masking data asserted to quantizer 6, by controller 4, for the band is determined by an uncorrected preliminary masking value (an excitation value) for said band.

The masking data asserted by controller 4 to quantizer 6 for each frequency band of the frequency-domain data 3 comprises a masking curve value for the band. These masking curve values represent the amount of signal masked by the human ear in each frequency band. As in the FIG. 1 system, quantizer 6 of FIG. 2 uses this information to decide how best to use the available number of data bits to represent the components of each frequency band of the input audio signal.

More specifically, controller 4 is configured to compute PSD values in response to the re-tented exponents asserted thereto from stage 18, to compute banded PSD values in response to the PSD values, to compute the masking curve in response to the banded PSD values, and to determine mantissa bit allocation data (the "masking data" indicated in FIG. 2) in response to the masking curve.

The audio encoder of FIG. 2 is configured to generate encoded audio data 9 including by performing adaptive low frequency compensation on audio data 3. To implement such adaptive low frequency compensation, the FIG. 2 system includes tonality detection stage (tonality detector) 15 and adaptive re-tenting stage 18, coupled as shown, and controller 4 performs low frequency compensation in response to re-tented exponents generated by stage 18. Tenting stage 10 is coupled to receive raw exponents of frequency-domain audio data 3, and configured to determine a tented exponent for each low frequency band of the above-mentioned set of low frequency bands of audio data 3, in a manner to be described in more detail below.

Tonality detector 15 is coupled to receive the original (raw) exponents of the audio data 3, and the tented exponents generated by stage 10 in response to these original exponents during a sweep (from low to high frequency) through the set of low frequency bands of audio data 3.

Stage 10 is configured to determine the difference between the exponents of the frequency-domain audio data 3 for consecutive frequency bands of data 3, and to generate a tented version of each such exponent (a tented exponent). The tenting is performed in the conventional manner mentioned above, during a sweep (from low to high frequency) through the frequency-domain data 3 (including the frequency bands of the set of low frequency bands on which adaptive low frequency compensation is to be performed), so that a tented exponent is generated for each frequency bin during the sweep. Stage 10 determines the differential exponent for each band (the exponent of each "next" bin, "N+1," minus the exponent of the current (lower frequency) bin "N"). If the differential exponent for bin "N" is greater than 2 (i.e., exp(N+1)−exp(N)>2), then stage 10 determines the tented exponent for the bin "N+1" to be the smallest exponent (tent exp(N+1)) that satisfies tent exp(N+1)−exp(N)=2. In this case, the tented exponent for bin N (tent exp(N)) is equal to the original exponent for bin N (tent exp(N)=exp(N)), and stage 10 asserts to stage 18 the differential tented exponent value 2 for bin N. If the differential exponent for bin "N" is less than −2 (i.e., exp(N+1)−exp(N)<−2), then stage 10 determines the tented exponent for the bin "N" to be the largest exponent (tent exp(N)) that satisfies exp(N+1)−tent exp(N)=−2. In this case, the tented exponent for bin N+1 (tent exp(N+1)) is equal to the original exponent for bin N+1 (tent exp(N+1)=exp(N+1)) and stage 10 asserts to stage 18 the differential tented exponent value −2 for bin N.

Tonality detector 15 is configured to perform tonality detection on the original exponents comprising audio data 3, and the tented exponents generated by stage 10 in response to these original exponents during a sweep (from low to high frequency) through the set of low frequency bands of audio data 3. The steep rises and falls characteristic of the PSD values (as a function of frequency) of a tonal signal imply that such a signal is tented more often than is a non-tonal signal (e.g., a non-tonal signal indicative of applause).

Figure 3:
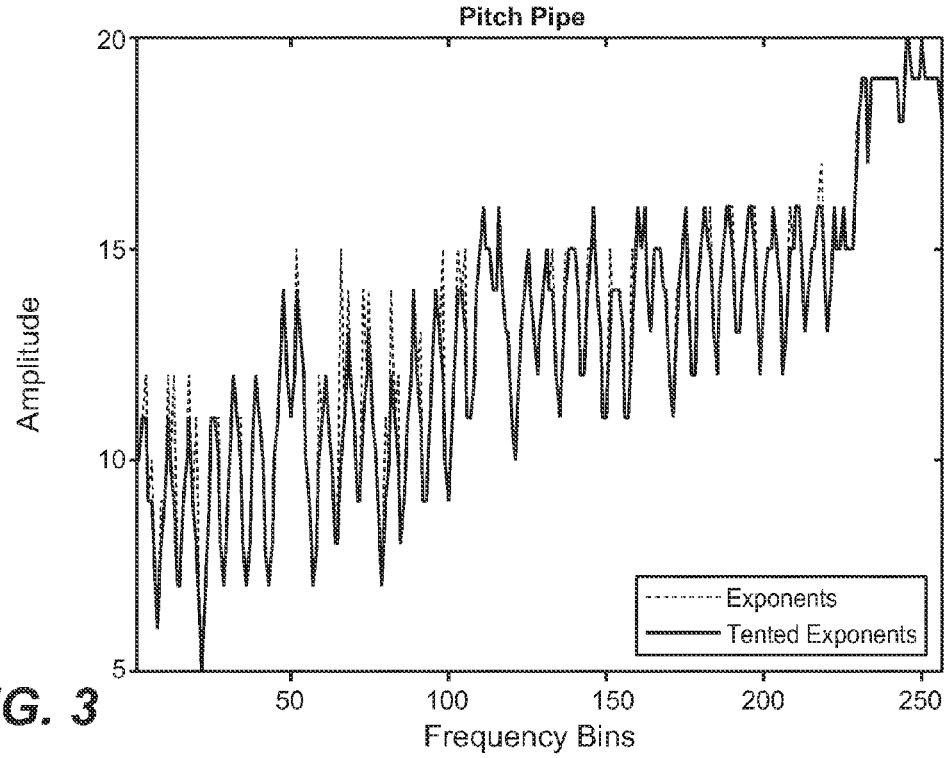
FIG. 3 is a graph of exponents and tented exponents of frequency domain audio data indicative of a pitch pipe (tonal) signal, as a function of frequency bin.
Figure 4:
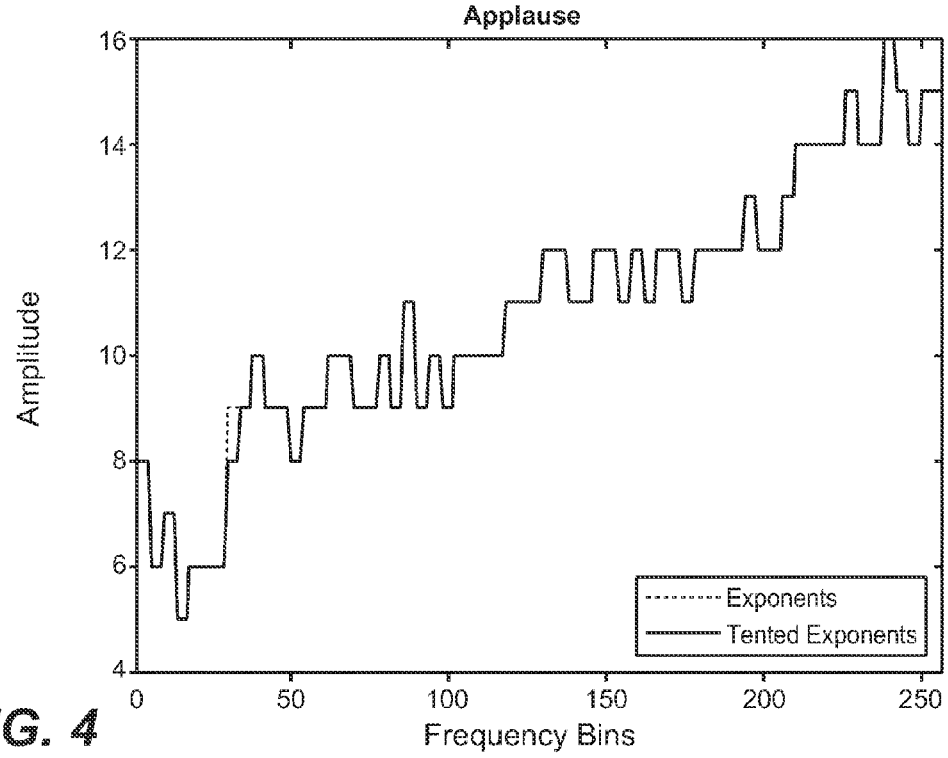
FIG. 4 is a graph of exponents and tented exponents of frequency domain audio data indicative of an applause (non-tonal) signal, as a function of frequency bin.
Figure 5:
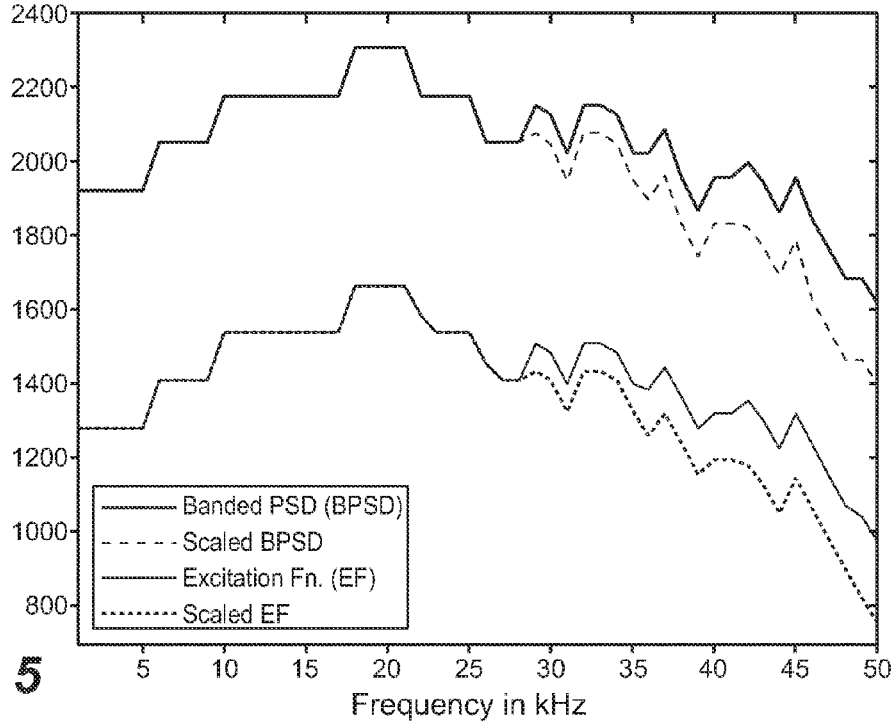
FIG. 5 is a graph of banded PSD (perceptual energy) values (the top curve) of banded, frequency domain audio data, a graph of scaled banded PSD values (the second curve from the top) generated by applying a conventional BABNDNORM process to the audio data, a graph of an excitation function (the third curve from the top) generated for use in masking the audio data, and a graph of a scaled version of the excitation function (the bottom curve) generated by applying a conventional BABNDNORM process to the excitation function. Each of the four curves is represented on a perceptual band (Bark frequency) scale.
Figure 6:
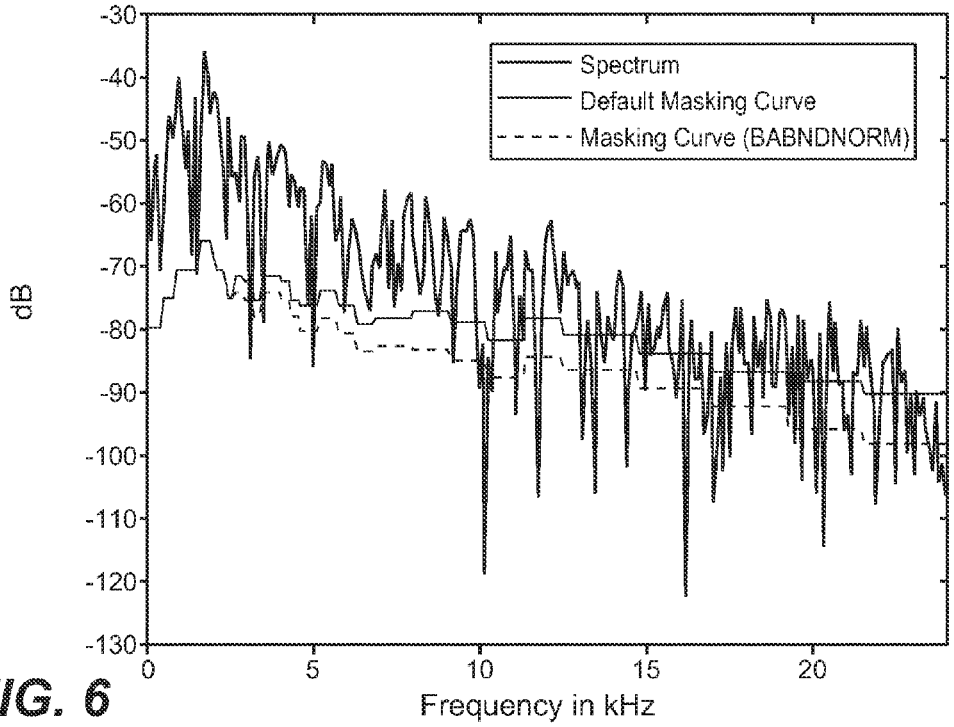
FIG. 6 is a graph of a frequency spectrum of an audio signal, a graph of a default masking curve for masking the audio signal (the second curve from the bottom), and a graph of a scaled version of the masking curve (the bottom curve) generated by applying a conventional BABNDNORM process to the masking curve.

For example, FIG. 3 is a graph of exponents and tented exponents of frequency domain audio data indicative of a tonal signal (a pitch pipe signal), as a function of frequency bin. FIG. 4 is a graph of exponents and tented exponents of frequency domain audio data indicative of a non-tonal (applause) signal, also plotted as a function of frequency bin. At the lower frequencies, at which low frequency compensation is typically performed, each bin (of FIGS. 3 and 4) corresponds to a single frequency band. As apparent from inspection of FIG. 3, there are many frequency bands in the low frequency range (e.g., bins 7, 11, 14, 15, 20, and 23) in which there is a non-zero difference between an exponent and the corresponding tented exponent (generated from the exponent, e.g., by stage 10) of the tonal signal. As apparent from inspection of FIG. 4, there are fewer frequency bands in the low frequency range (bin 34 only) in which there is a non-zero difference between an exponent and the corresponding tented exponent of the non-tonal signal.

Thus, a typical embodiment of tonality detector 15 determines a mean squared difference measure between exponents and corresponding tented exponents of a set of frequency domain audio data (or another measure indicative of difference between exponents and corresponding tented exponents of such data). For example, during a sweep (from low to high frequency) through the low frequency bands (of the noted set of low frequency bands of data 3) from the first (lowest) frequency band through band N+1, an implementation of detector 15 generates the tonality measure for band N+1 to be the mean of the squared differences between the original exponent and the tented exponent for each band in the range from the first band to band N+1.

Such a mean squared difference measure is employed to determine compensation control data, indicative of tonality (presence or lack of prominent tonal content) of the audio signal in the frequency range from the lowest frequency band through the current frequency band (band N+1)). For each frequency range (from the lowest frequency band through the current frequency band), if the mean squared difference measure (for the frequency range) has a value less than a specific predetermined threshold (e.g., an experimentally determined threshold), detector 15 asserts (to stage 18) compensation control data with a first value (e.g., a binary bit equal to zero), to indicate a non-tonal audio signal. This triggers the re-tenting by stage 18 of the differential exponent value asserted by stage 10 for the current band, thereby triggering a decoder compatible lowcomp switch OFF by controller 4 (i.e., preventing controller 4 from applying conventional low frequency compensation on the current band). In the example described below, the threshold is taken to be 0.05.

For each frequency range (from the lowest frequency band through the current frequency band), if the mean squared difference measure (for the frequency range) has a value greater than or equal to the threshold, detector 15 asserts (to stage 18) compensation control data with a second value (e.g., a binary bit equal to one), to indicate a tonal audio signal. This disables re-tenting by stage 18 of the differential exponent value asserted by stage 10 for the current band, thereby allowing this value (asserted at the output of stage 10) to pass unchanged through stage 18 to controller 4, and thus triggers a decoder compatible lowcomp switch ON by controller 4 (i.e., allows controller 4 to apply conventional low frequency compensation on the current band).

In alternative embodiments, detector 15 generates the compensation control data in another manner, but such that the compensation control data is indicative of the tonality (or non-tonality) of the audio signal determined by data 3 in each frequency band of data 3, or in each low frequency band of data 3, or in a frequency range comprising a set (or subset) of the low frequency bands of data 3 on which adaptive low frequency compensation is to be performed. For example, in some embodiments, detector 15 is implemented as a dedicated tonality detector that operates on the output of BFPE stage 7 (not specifically on exponents of the output of BFPE stage 7 and tented exponents output from stage 10).

For another example, in some embodiments detector 15 (or another tonality detector employed in any of the embodiments) is an applause detector configured to generate compensation control data indicative of whether a set of low frequency bands of audio data (e.g., whether each low frequency band of the set) represents applause. In this context, "applause" is used in a broad sense which may denote either applause only, or applause and/or a crowd cheer. Low frequency compensation would be disabled (switched OFF) for each frequency band in the set that is indicative of applause, or on all bands in the set if at least one of the bands in the set is indicative of applause, as indicated by the compensation control data. Low frequency compensation would be performed on the audio data in each frequency band in the set that is not indicative of applause as indicated by the compensation control data.

In response to compensation control data from detector 15 indicating a non-tonal audio signal (e.g., indicating that the audio signal determined by data 3 is a non-tonal signal in the low frequency range from the lowest frequency band of data 3 through the current band (band N), stage 18 performs re-tenting on the tented exponent of the current band. Specifically, if the differential tented exponent for the current band (the tented exponent of band N+1 minus the tented exponent of band N is equal to −2 (which is indicative of a steep increase (12 dB) in PSD from the previous band, N, to the current (higher frequency) band, N+1, stage 18 determines the differential re-tented exponent for the band "N+1" to be equal to −1. Thus, in response to compensation control data from detector 15 indicating a non-tonal audio signal (e.g., indicating that the audio signal determined by data 3 is a non-tonal signal in the low frequency range from the lowest frequency band of data 3 through the current band (band N) of data 3), controller 4 does not perform low frequency compensation on the current frequency band (N) of audio data 3.

In response to compensation control data from detector 15 indicating a tonal audio signal (e.g., indicating that the audio signal determined by data 3 is a tonal signal in the low frequency range from the lowest frequency band of data 3 through the current band (band N) of data 3), stage 18 passes through to controller 4 the tented exponent difference for the current band (without changing the tented exponent difference), and controller 4 is allowed to perform low frequency compensation on the current frequency band (N) of audio data 3. Specifically, controller 4 performs low frequency compensation on the current frequency band (N) of audio data 3 if the tented exponent difference value output from stage 10 (and passed through to controller 4 via stage 18) for the band is equal to −2.

More generally, the tonality detector of typical embodiments of the invention is configured to determine whether low frequency compensation should be applied to audio data of each frequency band of a set of low frequency bands (i.e., by generating compensation control data indicating whether low frequency compensation of each frequency band of the set of low frequency bands should be switched ON because the band has prominent tonal content, or switched OFF because the band lacks prominent tonal content, during encoding of the audio data of the set of low frequency bands). The low frequency compensation control stage of typical embodiments of the invention is configured to adaptively enable application of low frequency compensation to the audio data of each band of the set of low frequency bands in response to the compensation control data, in a manner that requires no decoder changes (i.e., in a manner that allows a decoder to perform decoding of the encoded audio data without determining (or being informed as to) whether or not low frequency compensation was applied to any low frequency band during encoding.

In typical embodiments, in response to compensation control data indicating that a frequency band of the audio data to be encoded is indicative of a non-tonal signal (for which low frequency compensation should be disabled), a preferred embodiment of the low frequency compensation control stage "re-tents" the tented audio data (e.g., the differential tented exponent) of the band by artificially modifying the relevant differential exponent determined by the tented data. The re-tenting generates modified audio data for the band such that the modified (re-tented) differential exponent for the band is prevented from being equal to −2 (e.g., so that the modified exponent of the modified audio data for the band, minus the exponent of the audio data in the next lower frequency band must be equal to 2, 1, 0, or −1). In typical embodiments of the inventive encoder, lowcomp compensation would not be applied to the band because the criterion for applying lowcomp compensation to the band (a PSD increase of 12 dB for the band, relative to the PSD for the next lower frequency band) would not be met (this criterion could not be met because the exponent of the modified audio data for the band, minus the exponent for next lower frequency band, is prevented from being equal to −2).

Low frequency compensation can be switched OFF (in accordance with typical embodiments of the invention) without a decoder change by artificially modifying ("re-tenting") exponents for the low frequency bands such that the differential exponent (for adjacent low frequency bands) is never equal to −2 (i.e., to avoid a PSD increase of 12 dB during a scan from lower to higher frequency bands), and thus to avoid application of lowcomp compensation. When the inventive tonality detector indicates a non-tonal signal, tented exponents for the low frequency bands are re-tented to such effect. This requires no change to the psychoacoustic model employed to generate masking data (signal-to-mask ratios) for quantizing the mantissa values, and hence generates encoded data that can be decoded by conventional decoders. More specifically, during scanning through the low frequency bands, with band "N+1" being the next band, and the current band ("N") having lower frequency than the next band, if it is preliminarily determined that a differential exponent (the exponent for band N+1 minus the exponent for band N) is equal to −2, the exponent of one of the bands is changed ("re-tented") so that the differential exponent of the modified exponent values is equal to −1 (i.e., a modified exponent for band N+1 minus the exponent for band N is equal to −1, or the exponent for band N+1 minus a modified exponent for band N is equal to −1). Preferably, if the exponent for band N+1 minus the exponent for band N is equal to −2, this difference is increased to −1 by decreasing ("re-tenting") the exponent for band N (the current band) so that the exponent for band N+1 minus the modified exponent for band N is equal to −1. The latter implementation of the re-tenting is typically preferable since, generally, it is not desirable to increase exponent values since there is an assumption that the corresponding mantissas may be fully normalized. Increasing an exponent value corresponding to a fully normalized mantissa would result in an over-normalized, or clipped mantissa, which is undesirable. Therefore, if the exponent for band N+1 minus the exponent for band N is equal to −2, in order to increase this difference to −1, it is typically preferable to decrease by one the exponent for band N (rather than to increase by one the exponent for band N+1).

When the inventive tonality detector indicates a tonal signal, exponents of the input audio frequency components are not re-tented, and low frequency compensation is applied in the conventional manner to the tonal signal (i.e., to the conventionally tented values indicative of the tonal signal).

The inventors have performed a listening test which compared performance of a conventional E-AC-3 encoder with that of a modified version of the E-AC-3 encoder (implementing adaptive lowcomp compensation of the type described with reference to FIG. 2). The test showed the benefits of the latter (modified) encoder not only for applause signals tested, but also for some non-applause signals. More specifically, at 192 kb/s with a tonality detector threshold equal to 0.05 (i.e., a tonality detector configured to generate control data indicating a non-tonal signal for which lowcomp compensation should be switched OFF (by re-tenting of exponents of the frequency domain audio data to be encoded) when a mean squared difference measure between exponents and tented exponents of the frequency domain audio has a value less than the threshold of 0.05), the average percentage of blocks for which lowcomp compensation was switched OFF, was 0.5% and 80%, for pitch pipe (long term, highly tonal, low frequency) input audio and applause (highly non-tonal, low frequency) input audio, respectively.

As noted, the steep rise and fall characteristic of the PSD of a tonal signal implies that such signals are tented more often than non-tonal signals, and thus, mean squared difference between exponents and tented exponents can serve as an indicator of tonality. A tonality indicator value less than a specific threshold (determined experimentally) implies non-tonal signals for which lowcomp should be switched OFF; and vice versa. In typical implementations, the tonality indicator value is computed (e.g., by detector 15 of FIG. 2) during a sweep through the frequency bands of the audio data to be encoded (e.g., data 3 of FIG. 2) until the current frequency band's frequency reaches the coupling begin frequency (when coupling is in use). If Adaptive Hybrid Transform (AHT) is in use, operation of the inventive adaptive lowcomp processing may be disabled, and conventional (non-adaptive) lowcomp processing may be performed instead. AHT is described in the above-referenced Dolby Digital/Dolby Digital Plus Specification and in the above-referenced "Dolby Digital Audio Coding Standards," book chapter by Robert L. Andersen and Grant A. Davidson in *The Digital Signal Processing Handbook*, Second Edition, Vijay K. Madisetti, Editor-in-Chief, CRC Press, 2009.

In a first class of embodiments, the invention is a mantissa bit allocation method for determining mantissa bit allocation of audio data values of frequency domain audio data to be encoded (including by undergoing quantization). The allocation method includes a step of determining masking values for the audio data values (e.g., in controller 4 of FIG. 2), including by performing adaptive low frequency compensation on the audio data of each frequency band of a set of low frequency bands of the audio data, such that the masking values are useful to determine signal-to-mask values which determine the mantissa bit allocation for said audio data. The adaptive low frequency compensation includes the steps of:

(a) performing tonality detection on the audio data (e.g., in tonality detector 15 of FIG. 2) to generate compensation control data indicative of whether each frequency band in the set of low frequency bands has prominent tonal content; and (b) performing low frequency compensation on the audio data in each frequency band in the set of low frequency bands having prominent tonal content as indicated by the compensation control data, including by correcting a preliminary masking value for said each frequency band having prominent tonal content, but not performing low frequency compensation on the audio data in any other frequency band in the set of low frequency bands, so that the masking value for each said other frequency band is an uncorrected preliminary masking value.

In some embodiments in the first class, step (a) includes a step of performing tonality detection (e.g., in tonality detector 15 of FIG. 2) on the audio data to generate compensation control data indicative of whether each frequency band of at least a subset of the frequency bands of the audio data has prominent tonal content, and the step of determining masking values for the audio data values also includes a step of:

(c) performing a masking value correction process in a first manner for said each frequency band of the audio data having prominent tonal content as indicated by the compensation control data, including by correcting a preliminary masking value for said each frequency band having prominent tonal content, and performing the masking value correction process in a second manner for said each frequency band of the audio data which lacks prominent tonal content as indicated by the compensation control data.

For example, the masking value correction process may be a BABNDNORM process, said each frequency band may be a perceptual band, and step (c) may include the step of performing the BABNDNORM process with a first scaling constant for said each frequency band having prominent tonal content, and performing the BABNDNORM process with a second scaling constant for said each frequency band which lacks prominent tonal content.

Another embodiment of the invention is an encoding method including any embodiment of such a mantissa allocation method.

In a second class of embodiments, the invention is an audio encoding method which overcomes the limitations of conventional encoding methods that apply low frequency compensation to all input audio signals (including both signals with tonal and non-tonal low frequency content), or do not apply low frequency compensation to any input audio signal. These embodiments selectively (adaptively) apply low frequency compensation during encoding of audio signals having prominent low-frequency tonal components, but not during encoding of audio signals that do not have prominent low-frequency tonal components (e.g., applause or other audio signals having low-frequency non-tonal content but not prominent tonal low-frequency content). The adaptive low frequency compensation is performed in a manner that allows a decoder to perform decoding of the encoded audio without determining (or being informed as to) whether or not low frequency compensation was applied during the encoding.

A typical embodiment in the second class is an audio encoding method including the steps of:

(a) performing tonality detection on frequency domain audio data (e.g., in tonality detector 15 of FIG. 2) to generate compensation control data indicative of whether each low frequency band of a set of at least some low frequency bands of the audio data has prominent tonal content; and (b) performing low frequency compensation (e.g., in controller 4 of FIG. 2) to generate a corrected masking value for the audio data in each said low frequency band having prominent tonal content as indicated by the compensation control data, and generating a masking value for the audio data in each other low frequency band in the set without performing low frequency compensation (e.g., in controller 4 of FIG. 2).

In some embodiments in the second class, the audio encoding method is an AC-3 or Enhanced AC-3 encoding method. In these embodiments, the low frequency compensation is preferably performed (i.e., is ON or enabled) for frequency bands of input audio data for which lowcomp was initially designed (i.e., frequency bands indicative of prominent, long-term stationary ("tonal"), low frequency content), and is not performed (i.e., is OFF or effectively disabled) otherwise. In these embodiments, in response to compensation control data indicating that low frequency compensation should not be performed on a frequency band of the audio data (e.g., compensation control data indicating that the band includes non-tonal audio content but not prominent tonal content), step (b) preferably includes a step of "re-tenting" the audio data in said band to generate modified audio data for the band, said modified audio data for the band including a modified exponent. The re-tenting generates the modified audio data for the band such that the differential exponent for the band is prevented from being equal to −2 (e.g., so that the modified exponent of the modified audio data for the band, minus the exponent of the audio data in the next lower frequency band must be equal to 2, 1, 0, or −1). Thus, lowcomp compensation would not be applied to the band because the criterion for applying lowcomp compensation to the band (a PSD increase of 12 dB for the band, relative to the PSD for the next lower frequency band) would not be met (this criterion could not be met if the exponent of the modified ("re-tented") audio data for the band, minus the exponent for next lower frequency band, is prevented from being equal to −2).

In some embodiments in the second class, step (a) includes a step of performing tonality detection (e.g., in tonality detector 15 of FIG. 2) on the audio data to generate compensation control data indicative of whether each frequency band of at least a subset of the frequency bands of the audio data has prominent tonal content, and the step of determining masking values for the audio data values also includes a step of:

(c) performing a masking value correction process (e.g., in controller 4 of FIG. 2) in a first manner for said each frequency band of the audio data having prominent tonal content as indicated by the compensation control data, and performing the masking value correction process in a second manner for said each frequency band of the audio data which lacks prominent tonal content as indicated by the compensation control data.

For example, the masking value correction process may be a BABNDNORM process, said each frequency band may be a perceptual band, and step (c) may include the step of performing the BABNDNORM process with a first scaling constant for said each frequency band having prominent tonal content, and performing the BABNDNORM process with a second scaling constant for said each frequency band which lacks prominent tonal content.

As noted, some embodiments of the inventive encoding method (and mantissa bit allocation method) use the inventive compensation control data to modify BABNDNORM aspects of encoding/decoding.

In a class of embodiments, the inventive encoding method uses the inventive compensation control data to modify BABNDNORM aspects of encoding/decoding as follows. Both conventional BABNDNORM and the inventive adaptive low frequency compensation methods have a similar purpose, namely, redistributing coding bits towards higher frequencies at the expense of lower frequencies. But, conventional BABNDNORM comes with an additional cost of transmitting the deltas to the decoder.

For an optimal usage of both BABNDNORM and the inventive adaptive low frequency compensation, the encoder is configured to adjust the BABNDNORM scaling constant for a perceptual band based on the adaptive lowcomp decision for the band. For example, in an implementation of the FIG. 2 system, if the compensation control data generated by tonality detector 15 for a band indicates that low frequency compensation should be disabled (OFF), a masking data generation stage of controller 4 chooses the scaling constant of BABNDNORM (in response to the compensation control data) such that the masking threshold is lowered by a lesser amount. If the compensation control data generated by tonality detector 15 for a band indicates that low frequency compensation should be enabled (ON), the masking data generation stage chooses the scaling constant of BABNDNORM (in response to the compensation control data) such that the masking threshold is lowered by a greater amount.

In some embodiments of the inventive method, when the tonality detection step indicates non-tonal content for any low frequency band (or for all low frequency bands, considered together) in the set to which lowcomp would conventionally be applied, lowcomp compensation is "not applied" (or switched OFF or effectively disabled) in the following sense. In response to the inventive tonality detection step indicating non-tonal content for at least one low frequency band in the set, subtraction of nonzero lowcomp parameters from the excitation values for all the bands in the set terminates (e.g., immediately). At this point, lowcomp is prevented from making any mask adjustment (until commencement of a new sweep through the bands of a next set of frequency domain audio data).

As noted above, in some embodiments of the inventive method, the compensation control data indicates whether each individual low frequency band in the set has prominent tonal content, and low frequency compensation is selectively applied (or not applied) to each individual low frequency band in the set. In other embodiments of the inventive method, the compensation control data indicates whether the low frequency bands in the set (considered together) have prominent tonal content, and low frequency compensation is either applied to all the low frequency bands in the set or is not applied to any of the low frequency bands in the set (depending on the content of the compensation control data). One class of embodiments implements a binary (wideband) decision as to whether to enable or disable lowcomp for an entire low frequency region. In some embodiments in this class, if the tonality detection indicates that lowcomp should be disabled, re-tenting will eliminate all differential exponents of value −2 from the low frequency lowcomp region, such that the lowcomp parameter is always 0. However, other embodiments of the inventive method implement a more fine-grain tonality decision, such that lowcomp is allowed to remain active for some frequency regions of the entire low frequency region but is disabled in others.

Figure 7:
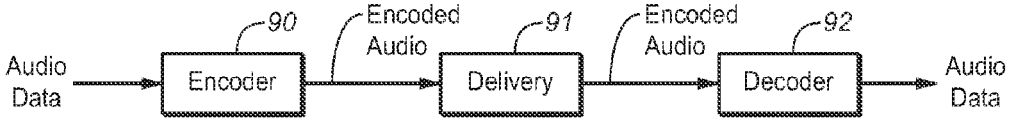
FIG. 7 is a block diagram of a system including an encoder configured to perform any embodiment of the inventive encoding method to generate encoded audio data in response to audio data, and a decoder configured to decode the encoded audio data to recover the audio data.

Another aspect of the invention is a system including an encoder configured to perform any embodiment of the inventive encoding method to generate encoded audio data in response to audio data, and a decoder configured to decode the encoded audio data to recover the audio data. The FIG. 7 system is an example of such a system. The system of FIG. 7 includes encoder 90, which is configured (e.g., programmed) to perform any embodiment of the inventive encoding method to generate encoded audio data in response to audio data, delivery subsystem 91, and decoder 92. Delivery subsystem 91 is configured to store the encoded audio data generated by encoder 90 and/or to transmit a signal indicative of the encoded audio data. Decoder 92 is coupled and configured (e.g., programmed) to receive the encoded audio data from subsystem 91 (e.g., by reading or retrieving the encoded audio data from storage in subsystem 91, or receiving a signal indicative of the encoded audio data that has been transmitted by subsystem 91), and to decode the encoded audio data to recover the audio data (and typically also to generate and output a signal indicative of the audio data).

Another aspect of the invention is a method (e.g., a method performed by decoder 92 of FIG. 7) for decoding encoded audio data, including the steps of receiving a signal indicative of encoded audio data, where the encoded audio data have been generated by encoding audio data in accordance with any embodiment of the inventive encoding method, and decoding the encoded audio data to generate a signal indicative of the audio data.

The invention may be implemented in hardware, firmware, or software, or a combination of both (e.g., as a programmable logic array). Unless otherwise specified, the algorithms or processes included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems (e.g., a computer system which implements the encoder of FIG. 2), each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

For example, when implemented by computer software instruction sequences, various functions and steps of embodiments of the invention may be implemented by multithreaded software instruction sequences running in suitable digital signal processing hardware, in which case the various devices, steps, and functions of the embodiments may correspond to portions of the software instructions.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be implemented as a computer-readable storage medium, configured with (i.e., storing) a computer program, where the storage medium so configured causes a computer system to operate in a specific and predefined manner to perform the functions described herein.

A number of embodiments of the invention have been described. Nevertheless, it will be understood that various modifications may be made without departing from the spirit and scope of the invention. Numerous modifications and variations of the present invention are possible in light of the above teachings. It is to be understood that within the scope of the appended claims, the invention may be practiced otherwise than as specifically described herein.

What is claimed is:

1. An audio encoding method, including the steps of:

(a) performing tonality detection on frequency domain audio data to generate compensation control data indicative of whether each low frequency band of a set of at least some low frequency bands of the audio data has prominent tonal content;

(b) for said each low frequency band, generating a preliminary masking value for the audio data in the band; and (c) for said each low frequency band, determining a masking value for the audio data in the band, wherein the masking value for the audio data in each said low frequency band having prominent tonal content as indicated by the compensation control data is obtained by performing low frequency compensation to correct the preliminary masking value for the audio data in the band, and the masking value for the audio data in each other low frequency band in the set is the preliminary masking value for the audio data in the band, wherein the frequency domain audio data comprises an exponent value for said each low frequency band of the set, and step (a) includes a step of determining, for said each low frequency band of the set, a measure of difference between exponents and corresponding tented exponents of the audio data.

2. The method of claim 1, wherein the compensation control data are indicative of whether at least one band of the set represents crowd noise or applause, and step (c) includes a step of:

generating a masking value, without performing low frequency compensation, for the audio data in each low frequency band of the set which represents applause or crowd noise, as indicated by the compensation control data.

3. The method of claim 1, wherein step (c) includes a step of re-tenting the audio data in each low frequency band of the set which lacks prominent tonal content as indicated by the compensation control data, to generate modified audio data including a modified exponent for at least one said low frequency band which lacks prominent tonal content.

4. The method of claim 3, wherein the step of re-tenting generates the modified exponent for at least one said low frequency band which lacks prominent tonal content such that the exponent of the audio data in the next higher frequency band minus said modified exponent must have one of the values 2, 1, 0, and −1.

5. The method of claim 1, wherein step (a) includes a step of performing tonality detection on the audio data to generate compensation control data indicative of whether each frequency band in at least a subset of the frequency bands of the audio data has prominent tonal content, said method also including a step of:

(d) performing a masking value correction process in a first manner for said each frequency band of the audio data having prominent tonal content as indicated by the compensation control data, and performing the masking value correction process in a second manner for said each frequency band of the audio data which lacks prominent tonal content as indicated by the compensation control data.

6. The method of claim 5, wherein the masking value correction process is a BABNDNORM process, and step (d) includes the step of performing the BABNDNORM process with a first scaling constant for said each frequency band having prominent tonal content, and performing the BABNDNORM process with a second scaling constant for said each frequency band which lacks prominent tonal content.

7. The method of claim 1, wherein the measure of difference is a measure of mean squared difference between exponents and corresponding tented exponents of the audio data.

8. The method of claim 1, wherein the compensation control data indicates whether each individual low frequency band in the set has prominent tonal content, and in step (c), low frequency compensation is selectively performed or not performed on each individual low frequency band in the set.

9. The method of claim 1, wherein the compensation control data indicates whether the low frequency bands in the set, considered together, have prominent tonal content, and low frequency compensation is performed in step (c) on all the low frequency bands in the set when the compensation control data indicates that the low frequency bands in the set, considered together, have prominent tonal content.

10. An audio encoder configured to generate encoded audio data in response to frequency domain audio data, including by performing adaptive low frequency compensation on the audio data, said encoder including:

a tonality detector configured to perform tonality detection on the audio data to generate compensation control data indicative of whether each low frequency band of a set of at least some low frequency bands of the audio data has prominent tonal content; and a low frequency compensation stage coupled and configured to adaptively perform, in response to the compensation control data, low frequency compensation on each low frequency band of the set of low frequency bands of the audio data, including by generating, for said each low frequency band, a preliminary masking value for the audio data in the band, and for said each low frequency band, determining a masking value for the audio data in the band, wherein the masking value for the audio data in each said low frequency band having prominent tonal content as indicated by the compensation control data is obtained by performing low frequency compensation to correct the preliminary masking value for the audio data in the band, and the masking value for the audio data in each other low frequency band in the set is the preliminary masking value for the audio data in the band, wherein the frequency domain audio data comprises an exponent value for said each low frequency band of the set, and the tonality detector is configured to determine, for said each low frequency band of the set, a measure of difference between exponents and corresponding tented exponents of the audio data.

11. The encoder of claim 10, wherein the compensation control data are indicative of whether at least one band of the set represents crowd noise or applause.

12. The encoder of claim 10, wherein the low frequency compensation stage is configured to adaptively enable application of low frequency compensation to the audio data of each band of the set of low frequency bands in response to the compensation control data, in a manner that allows a decoder to perform decoding of the encoded audio data without determining or being informed as to whether or not low frequency compensation was applied to any low frequency band during the encoding.

13. The encoder of claim 10, wherein the low frequency compensation stage is configured to re-tent the audio data in each said low frequency band which lacks prominent tonal content as indicated by the compensation control data, to generate modified audio data including at least one modified exponent.

14. The encoder of claim 13, wherein the low frequency compensation stage is configured to re-tent the audio data in each said low frequency band which lacks prominent tonal content as indicated by the compensation control data, including by generating the modified exponent for at least one said low frequency band which lacks prominent tonal content such that the exponent of the audio data in the next higher frequency band minus said modified exponent must have one of the values 2, 1, 0, and −1.

15. The encoder of claim 10, wherein the measure of difference is a measure of mean squared difference between exponents and corresponding tented exponents of the audio data.

16. The encoder of claim 10, wherein said encoder is a processor programmed with software that implements the tonality detector and the low frequency compensation stage.

17. The encoder of claim 10, wherein said encoder is a digital signal processor.

18. The encoder of claim 10, wherein the tonality detector is configured to perform tonality detection on the audio data to generate compensation control data indicative of whether each frequency band, of at least a subset of the frequency bands of the audio data, has prominent tonal content, and wherein encoder includes a masking value correction stage configured to perform a masking value correction process in a first manner for said each frequency band of the audio data having prominent tonal content as indicated by the compensation control data, and to perform the masking value correction process in a second manner for said each frequency band of the audio data which lacks prominent tonal content as indicated by the compensation control data.

19. The encoder of claim 18, wherein the masking value correction process is a BABNDNORM process, and the masking value correction stage is configured to perform the BABNDNORM process with a first scaling constant for said each frequency band having prominent tonal content, and to perform the BABNDNORM process with a second scaling constant for said each frequency band which lacks prominent tonal content.

20. A system including:

an encoder configured to generate encoded audio data in response to frequency domain audio data, including by performing adaptive low frequency compensation on the audio data; and a decoder configured to decode the encoded audio data to recover the audio data, wherein the encoder includes:

a tonality detector configured to perform tonality detection on the audio data to generate compensation control data indicative of whether each low frequency band of a set of at least some low frequency bands of the audio data has prominent tonal content; and a low frequency compensation stage coupled and configured to adaptively perform, in response to the compensation control data, low frequency compensation on each low frequency band of the set of low frequency bands of the audio data, including by generating, for said each low frequency band, a preliminary masking value for the audio data in the band, and for said each low frequency band, determining a masking value for the audio data in the band, wherein the masking value for the audio data in each said low frequency band having prominent tonal content as indicated by the compensation control data is obtained by performing low frequency compensation to correct the preliminary masking value for the audio data in the band, and the masking value for the audio data in each other low frequency band in the set is the preliminary masking value for the audio data in the band, wherein the frequency domain audio data comprises an exponent value for said each low frequency band of the set, and the tonality detector is configured to determine, for said each low frequency band of the set, a measure of difference between exponents and corresponding tented exponents of the audio data.

21. The system of claim 20, wherein the compensation control data are indicative of whether at least one band of the set represents crowd noise or applause.

22. The system of claim 20, wherein the decoder is configured to decode the encoded audio data without determining or being informed as to whether or not low frequency compensation was applied to any low frequency band during the encoding.

23. The system of claim 20, wherein the low frequency compensation stage is configured to re-tent the audio data in each said low frequency band which lacks prominent tonal content as indicated by the compensation control data, to generate modified audio data including at least one modified exponent.

24. The system of claim 23, wherein the low frequency compensation stage is configured to re-tent the audio data in each said low frequency band which lacks prominent tonal content as indicated by the compensation control data, including by generating the modified exponent for at least one said low frequency band which lacks prominent tonal content such that the exponent of the audio data in the next higher frequency band minus said modified exponent must have one of the values 2, 1, 0, and −1.

25. A method for decoding encoded audio data, including the steps of:

receiving a signal indicative of the encoded audio data; and decoding the encoded audio data to generate a signal indicative of the audio data, wherein the encoded audio data have been generated by:

(a) performing tonality detection on frequency domain audio data to generate compensation control data indicative of whether each low frequency band of a set of at least some low frequency bands of the audio data has prominent tonal content;

(b) for said each low frequency band, generating a preliminary masking value for the audio data in the band; and (c) for said each low frequency band, determining a masking value for the audio data in the band, wherein the masking value for the audio data in each said low frequency band having prominent tonal content as indicated by the compensation control data is obtained by performing low frequency compensation to correct the preliminary masking value for the audio data in the band, and the masking value for the audio data in each other low frequency band in the set is the preliminary masking value for the audio data in the band, wherein the frequency domain audio data comprises an exponent value for said each low frequency band of the set, and step (a) includes a step of determining, for said each low frequency band of the set, a measure of difference between exponents and corresponding tented exponents of the audio data.

26. The method of claim 25, wherein the compensation control data are indicative of whether at least one band of the set represents crowd noise or applause, and step (c) includes a step of:

generating a masking value, without performing low frequency compensation, for the audio data in each low frequency band of the set which represents applause or crowd noise, as indicated by the compensation control data.

27. The method of claim 25, wherein step (c) includes a step of re-tenting the audio data in each low frequency band of the set which lacks prominent tonal content as indicated by the compensation control data, to generate modified audio data including a modified exponent for at least one said low frequency band which lacks prominent tonal content.

28. The method of claim 27, wherein the step of re-tenting generates the modified exponent for at least one said low frequency band which lacks prominent tonal content such that the exponent of the audio data in the next higher frequency band minus said modified exponent must have one of the values 2, 1, 0, and −1.

* * * * *